US005500338A

United States Patent [19]

Kerr et al.

[11] Patent Number: 5,500,338

[45] Date of Patent: Mar. 19, 1996

[54] BLACK AND WHITE PHOTOGRAPHIC ELEMENTS CONTAINING RELEASE COMPOUNDS AND METHOD OF PREPARING PHOTOGRAPHIC EMULSION

[75] Inventors: Donald L. Kerr; Jerome J. Looker, both of Rochester, N.Y.

[73] Assignee: Eastman Kodak Company, Rochester, N.Y.

[21] Appl. No.: 455,944

[22] Filed: May 31, 1995

[51] Int. Cl.[6] ..... G03C 1/34; G03C 1/42; G03C 1/38; G03C 1/43

[52] U.S. Cl. ..... 430/611; 430/544; 430/566; 430/607; 430/955; 430/957; 430/959

[58] Field of Search ..... 430/955, 957, 430/959, 611, 544, 566, 607

[56] References Cited

U.S. PATENT DOCUMENTS

| | | | |
|---|---|---|---|
| 4,886,738 | 12/1989 | Deguchi et al. | 430/611 |
| 4,908,293 | 3/1990 | Katoh et al. | 430/264 |
| 4,948,714 | 8/1990 | Long et al. | 430/435 |
| 5,008,181 | 4/1991 | Ikegawa et al. | 430/955 |
| 5,116,717 | 5/1992 | Matsushita et al. | 430/955 |
| 5,283,162 | 2/1994 | Kapp et al. | 430/955 |
| 5,354,650 | 10/1994 | Southby et al. | 430/955 |

OTHER PUBLICATIONS

U.S. Patent Application 08/250,148 (Docket 68,568PCC).
U.S. Patent Application 08/250,748 (Docket 68,749PCCC).
U.S. Patent Application 08/250,189 (Docket 68,751PC).

*Primary Examiner*—Richard L. Schilling
*Attorney, Agent, or Firm*—Peter C. Cody

[57] ABSTRACT

The invention provides a black and white photographic element comprising a support having situated thereon at least one silver halide emulsion, the element containing a release compound that provides a non-imagewise distribution of a photographically active moiety, wherein the release compound has the structure wherein $R^1$ is an electron withdrawing moiety;

m is 0, 1, 2 or 3;

$R^2$ is a group containing an aqueous solubilizing group;

q is 1 or 2;

TIME is a timing group;

n is 0, 1, 2 or 3; and

PAM is a photographically active moiety.

Also provided is a method of preparing a photographic emulsion comprising precipitating silver halide grains in a colloidal medium, washing the grains, sensitizing the grains by adding dyes, chemical sensitizers and heating, and adding to the emulsion a methanolic solution comprising a release compound as described above.

9 Claims, No Drawings

BLACK AND WHITE PHOTOGRAPHIC ELEMENTS CONTAINING RELEASE COMPOUNDS AND METHOD OF PREPARING PHOTOGRAPHIC EMULSION

FIELD OF THE INVENTION

This invention relates to black and white silver halide photographic elements and, in particular, to black and white silver halide photographic elements containing release compounds which provide a non-imagewise distribution of a photographically active moiety. The invention also relates to a method of preparing a photographic emulsion utilizing the aforementioned release compounds.

BACKGROUND OF THE INVENTION

The quality of photographic materials is often measured in terms of the materials' speed/grain performance. That is, materials which exhibit high sensitivity or speed, as well as low granularity, are desired for being capable of delivering to the consumer the highest quality images.

Sensitivity may be improved in many ways, such as by adding chemical sensitizers to an emulsion during its formation, or by modifying the morphology and/or halide content or distribution of an emulsion's grains. The average size of the grains contained within an emulsion is also significantly related to sensitivity. The larger the grains, the greater the number of incident photons per grain at a given exposure, and thus the higher the probability that a latent image center will be formed. Increasing an emulsion's sensitivity solely by increasing its grain size, however, has attendant disadvantages, one of which is to increase the emulsion's granularity relative to a smaller grain emulsion exhibiting equivalent final image density. Increased granularity, in turn, impairs image quality, especially where magnification of the image is required, such as in enlarged prints or transparencies.

In black and white films in particular, control over granularity is desired. In these films, it is typical to coat relatively high levels of silver halide grains in an attempt to maximize the number of image centers and to provide the lowest granularity at a given sensitivity. By coating such high levels of silver halide, however, development can not be carried to completion because it would result in an image having unacceptably high contrast. This problem can be eliminated by a technique called partial grain development, which is the process of carrying out development for a controlled period of time and arresting it at an appropriate point prior to its completion when the desired contrast has been obtained. Precise control over contrast during partial grain development can be achieved by modifying the activity of the developer utilized in the development process. Alternatively, and generally preferably as it does not require any modification of the development process, control over contrast can be achieved by incorporating into the photographic emulsion a compound capable of restraining development of the exposed silver halide, such compound typically being referred to in the art as a development inhibitor or, simply, an inhibitor.

One of the characteristics that development inhibitors in black and white photographic elements must exhibit is that they restrain only the growth rate of grain development and not the initiation of grain growth. Otherwise, the number of image centers in the emulsion would be decreased by the development inhibitor and any speed/grain advantage resulting from the utilization of high levels of silver halide grains would be lost. To this end, the photographic industry has developed and utilized various release compounds which are capable of releasing development inhibitors and, for that matter, other photographically active moieties, after the initiation of grain growth. Such compounds have typically been comprised of blocking groups which release development inhibitors through a cross-oxidation reaction. Long, U.S. Pat. No. 4,948,714, is exemplary of this art, and it specifically describes compounds which imagewise release 1-aryltetrazole-5-thiol development inhibitors through a cross-oxidation reaction in the presence of a black and white developing solution.

The utility of compounds which release development inhibitors via a cross-oxidation reaction in black and white developing solutions is limited by the high sulfite levels typically present in such solutions. Sulfite acts as a scavenger of oxidized developer and thus interferes with the ability of the release compound to be oxidized and to release its development inhibitor. Therefore, alternative release compounds for the restraint of black and white processing have been sought.

In co-pending U.S. Ser. Nos. 08/250,148, 08/250,748 and 08/250,189 release compounds have been disclosed which react with nucleophiles contained in processing baths to release photographically active moieties in a non-imagewise manner. The release compounds are asserted to be of particular use in color reversal photographic elements where control over push (i.e., extended) processing is desired. They comprise a blocking group from which a photographically active moiety is released, the blocking group comprising both a solubilizing groups and a ballasting group. The solubilizing group enables release of the photographically active moiety from the release compound.

Although such compounds would likely release photographically active moieties in black and white films during development, they would be impractical as they would require substantial amounts of strong, environmentally harmful organic solvents in order to be incorporated into an emulsion. In color films, such as the reversal films of U.S. Ser. Nos. 08/250,148, 08/250,748 and 08/250,189, this problem is eliminated since the compounds can be incorporated into coupler dispersions or other solvents utilized in the coupler containing layers, such as diethyl lauramide. In black and white film, however, couplers and hence coupler solvents are not utilized, and thus alternative means for incorporating release compounds are needed.

One organic solvent that is commonly used in the preparation of most black and white films is methanol, and it has been used as a vehicle by which to add various hydrophobic addenda to gelatin containing emulsion layers. The present inventors have found, however, that the release compounds of U.S. Ser. Nos. 08/250,148, 08/250,748 and 08/250,189 are only marginally soluble in methanol and are thus relatively impractical for application to most black and white films where the manufacture of such films is desired to be achieved without the use of substantial amounts of strong environmentally harmful organic solvents. Applicants therefore sought to identify a class of release compounds at least as effective as those described in U.S. Ser. Nos. 08/250,148, 08/250,748 and 08/250,189, and capable of being used in modern black and white films where environmental considerations are of particular concern.

SUMMARY OF THE INVENTION

The invention thus provides a black and white photographic element comprising a support having situated thereon at least one silver halide emulsion, the element containing a release compound that provides a non-imagewise distribution of a photographically active moiety, wherein the release compound has the structure

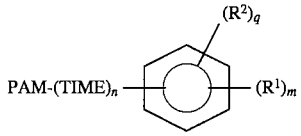

wherein $R^1$ is an electron withdrawing moiety;

m is 0, 1, 2 or 3;

$R^2$ is a group containing an aqueous solubilizing group;

q is 1 or 2;

TIME is a timing group;

n is 0, 1, 2 or 3; and

PAM is a photographically active moiety.

Also provided is a method of preparing a photographic emulsion comprising precipitating silver halide grains in a colloidal medium, washing the grains, sensitizing the grains by adding dyes, chemical sensitizers and heating, and adding to the emulsion a methanolic solution comprising a release compound as described above.

The invention provides the opportunity to achieve improved speed/grain performance in black and white photographic elements without having to use substantial amounts of undesired organic solvents for the incorporation of release compounds. By avoiding the use of such solvents, the prospects for environmental harm are diminished. Further, it is possible to avoid undesired interactions between certain solvents and the components of the element's emulsion layers which could result in impaired image quality.

DETAILED DESCRIPTION OF THE INVENTION

The present invention relates to a black and white photographic element containing a release compound that provides a non-imagewise distribution of a photographically active moiety. The release compound comprises a blocking group from which the photographically active moiety is released. The blocking group comprises a 6-membered aromatic ring and, optionally, a timing group or series of timing groups. A group containing an aqueous solubilizing group is attached to the blocking group's aromatic ring. The aromatic ring may also have attached one or more electron withdrawing groups.

Specifically, the release compound utilized in the element of the invention has the structure:

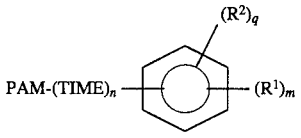

wherein $R^1$ is an electron withdrawing moiety;

m is 0, 1, 2 or 3, preferably 1 or 2;

$R^2$ is a group containing an aqueous solubilizing group;

q is 1 or 2, preferably 1;

TIME is a timing group;

n is 0, 1, 2 or 3, preferably 0 or 1; and

PAM is a photographically active moiety.

By timing group, it is meant any timing group known in the art, preferably one that functions by electron transfer down a conjugated chain or by cyclization reaction (nucleophilic displacement). Other groups which decompose to form small molecules such as carbon dioxide or formaldehyde are also contemplated. Suitable timing groups for practice with the present invention include those disclosed in U.S. Pat. Nos. 4,248,962; 4,409,323; 4,684,604; 5,034,311 and 5,055,385; and European Patent Application 0 167 168; all of which are incorporated herein by reference. Multiple timing groups are specifically contemplated and these may be the same or they may be different.

Electron withdrawing groups are those groups which display a positive Hammett sigma value as described, for example, in Advanced Organic Chemistry by F. A. Carey and R. J. Sundberg, volume A, pages 179–190; Plenum Press, New York 1984. Examples include nitro; nitroso; azido; azo; cyano; aryl or alkyl sulfones sulfoxides and ketones; aryloxy or alkyloxy carboxylate esters; sulfonate esters; phosphate esters; arylamino or alkylamino carboxylic amides; tertiary substituted alkylamino or arylamino sulfonamides; halogen; fluoroalkyl; and other similar groups. In the present invention, the electron withdrawing group is preferably non-ionizable under alkaline conditions.

Although many of the advantages of the present invention are obtained when the release compounds employed in the black and white elements release development inhibitors, it is specifically contemplated that other photographically active moieties can be released from the release compounds. The photographically active moieties can be any of the groups usefully made available in photographic elements. These include development accelerators, development inhibitors, bleach accelerators, bleach inhibitors, developing agents (e.g. competing developing agents or auxiliary developing agents), dyes, silver complexing agents, fixing agents, toners, hardeners, tanning agents, fogging agents, antifoggants, antistain agents, and stabilizers.

Examples of such photographically active moieties are disclosed in *Research Disclosure*, December 1989, Item No. 308119, Sections VII-F,I,J; VIII; X; XX; and XXI, which are incorporated herein by reference.

Preferably, the photographically active moiety is other than a dye. More preferably, it is a development inhibitor, a development accelerator or a developing agent. Optimally, it is a development inhibitor.

The photographically active moiety is inert when attached to the timing group or aromatic ring of the release compound's blocking group. Only upon release from one of these two groups can the photographically active moiety exert its intended effect. By inert, it is meant the moiety does not exert its ultimately desired effect. It may, however, exert other incidental photographic effects.

The photographically active moiety preferably contains a heteroatom which is blocked by direct attachment to the remainder of the release compound; i.e., the timing group(s) or aromatic ring. Upon removal of the timing group, when present, and the aromatic ring upon reaction of the release compound with a nucleophile contained in the processing bath, the photographically active moiety becomes active for its intended purpose.

Attached to the aromatic ring of the release compound's blocking group is a group that contains an aqueous solubilizing group. By aqueous solubilizing group, it is meant any group capable of facilitating the removal of the aromatic ring in a nucleophile containing processing bath at a rate which allows for the restraint of the growth rate of grain development but not the restraint of the initiation of grain development. The group should have an intrinsic hydrophilicity, or should be such as to be capable of substantial ionization under processing conditions. Examples include carboxylic acids; sulfonamides; thiols; cyanamides; ureas; sulfonylureas; imides; sulfonic acids; polyethers having greater than 3 repeating units; amines and polyamines; cationic centers such as ammonium, sulfonium or phosphonium groups; amides such as carbonamides or phosphonamides; alcohols or polyalcohols; and salts thereof.

The most preferred groups are polyethers, preferably those having greater than 3 repeating units; more preferably those comprising a polyethyleneoxy chain having at least 4 repeating units; and optimally those comprising a polyethyleneoxy chain having from 4 to about 20 repeating units.

In the present invention, the aqueous solubilizing group enables the aromatic ring to be removed from the remainder of the release compound during processing as a result of reaction with a nucleophile contained in the processing bath, thus releasing the timed or untimed photographically active moiety. The nucleophile contained in the processing bath can include any nucleophile present in black and white processing baths; preferably sulfite ions, oximes, hydroxylamines, thiocyanates, or thiolates; more preferably ions other than oxygen or nitrogen nucleophiles; and optimally sulfite ions. Sulfite ions can come from salts of sulfite, such as sodium sulfite or potassium sulfite; salts of bisulfite such as sodium bisulfite, potassium bisulfite, or sodium formaldehyde bisulfite; or salts of metabisulfite, such as sodium metabisulfite or potassium metabisulfite. The concentration of sulfite can be in the range of 0.0001 to 2.0 molar, preferably in the range 0.01 to 1.0 molar.

In the preferred embodiments of the present invention, the release compound has the structure

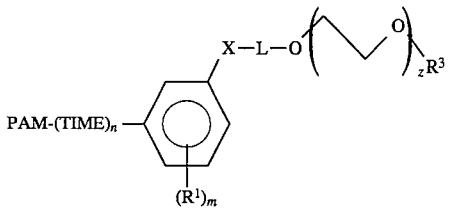

wherein

PAM, TIME, n, $R^1$ and m are as defined above;

X is selected from CONH or $SO_2NH$, preferably CONH;

L is a linking group comprising an aromatic substituent;

z is from 4 to 20; and $R^3$ is an alkyl or aryl group having less than 12 carbon atoms.

Groups suitable for L are those groups having at least one aromatic substituent, preferably a 5, 6, or 7 membered ring. The aromatic substituent may be monocyclic or polycyclic. It may be comprised of entirely carbon atoms, or it may contain heteroatoms so as to form a heteroaromatic ring system. Specific examples of groups having at least one aromatic substituent include benzene, pyridine, pyrrole, furan, thiophene, imidazole, thiazole, oxazole, pyrazole, isothiazole, isoxazole, triazole, tetrazole, pyrimidine, pyrazine, napthalene and similar rings.

Such rings may be substituted. Substituents include halogen, alkyl, alkenyl, alkynyl, aryl, heteroaryl, carboxy, carbonamido, cyano, sulfonamido, nitro, cyanofluoroalkyl, fluorosulfonyl, amino, sulfamyl, carbamyl, formyl, arylcarbonyl, alkylcarbonyl, carboxyaryl, carboxyalkyl, alkylcarbonamido, arylcarbonamido, fluoroarylsulfonyl, fluoroalkylsulfonyl, aryloxy, alkyloxy, arylthio, alkylthio, phosphenyl, and the like. Other suitable substituents include oxo, imine, oximino, alkylidene, arylidine, thio, and azimino groups.

$R^3$ in the above structure is an alkyl or aryl group having less than 12 carbon atoms. Because many of the advantages of the present invention are derived from the ability of the release compounds to be dissolved into methanol, it is preferable that $R^3$ comprise as few atoms as possible. This ensures a low level of hydrophobicity in the release compounds and allows for their incorporation into the desired solvent. $R^3$ preferably is an alkyl or aryl group having less than 8 carbon atoms. More preferably, it is an alkyl group having less than 5 carbon atoms; and optimally, it is methyl, ethyl or propyl.

As it is desired that $R^3$ comprise as few atoms as possible, it is also desired that neither the photographically active moiety, the timing group(s), when present, the 6-membered aromatic ring, nor the linking group be substituted with a ballasting group which would impact the ability of the release compounds to be dissolved in methanol. Ballasting groups are well known in the art. They are large organic molecules, typically containing at least 12, and usually more than 15 contiguous atoms, usually carbon atoms.

Known ballasting groups utilized in the release compounds of U.S. Ser. Nos. 08/250,148, 08/250,748 and 08/250,189 are 4-tridecyloxyphenyl, 4-(2,4-di-t-pentyl-phenoxy)butyl, 3-pentadecylphenyl, n-octadecyl, 5-tetradecylcarbonamido-2-chlorophenyl, 5-(N-methyl-N-octadecyl sulfamoyl)-2-chlorophenyl, 2-tetradecyloxyphenyl and 4-t-octylphenoxyphenyl. All of these groups substantially curtail the ability of the release compounds to be dissolved in other than strong organic solvents, the kind of which are not utilized in the preparation of black and white photographic emulsions.

In the more preferred embodiment of the present invention, the release compound has the structure:

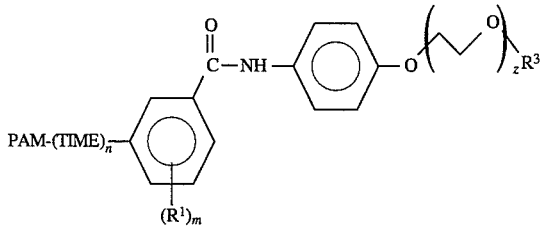

wherein

PAM, TIME, n, $R^1$ and m are as defined above;

z is from 4 to 20; and $R^3$ is an alkyl or aryl group having less than 8 carbon atoms, preferably an alkyl group having less than 5 carbon atoms.

Representative examples of the release compounds employed in the present invention are shown in the following tables.

TABLE IA

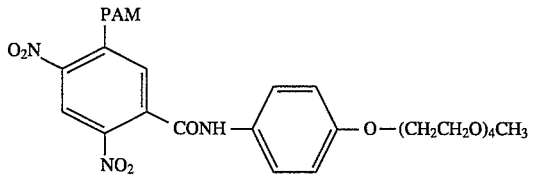

| Cmpd. No. | PAM |
|---|---|
| 1 | 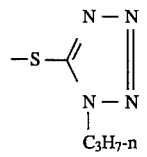 |

TABLE IA-continued
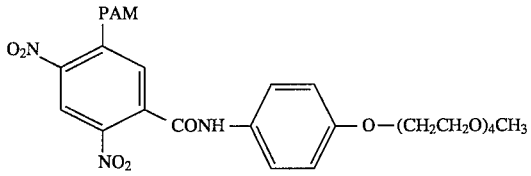
| Cmpd. No. | PAM |
|---|---|
| 2 | 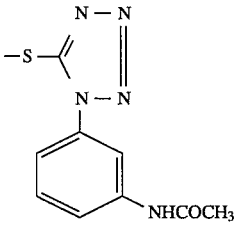 |
| 3 | 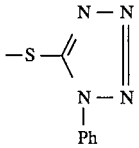 |
| 4 | 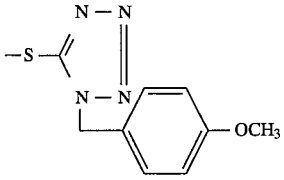 |
| 5 | 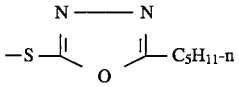 |
| 6 | 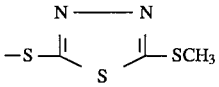 |
| 7 | 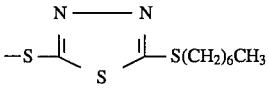 |
| 8 | 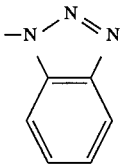 |
TABLE IA-continued
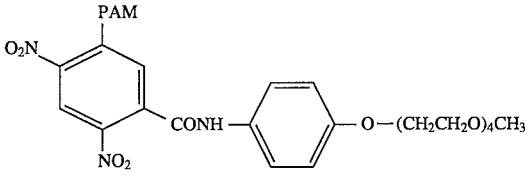
| Cmpd. No. | PAM |
|---|---|
| 9 | 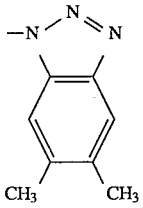 |
| 10 | 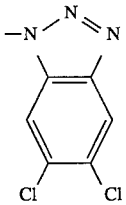 |
| 11 | 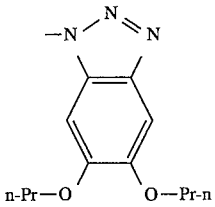 |
| 12 | 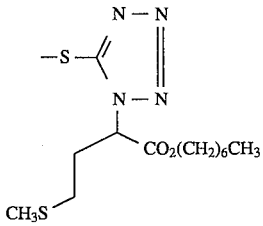 |
| 13 | 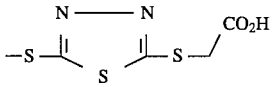 |
| 14 | 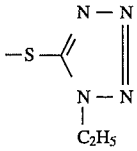 |

TABLE IB
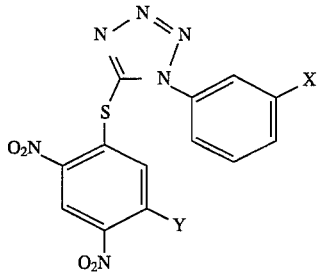
| Cmpd No. | X | Y |
|---|---|---|
| 15 | H | 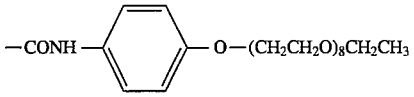 |
| 16 | H | 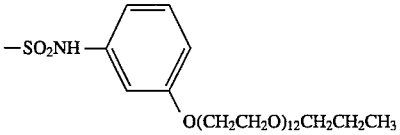 |
| 17 | $OCH_3$ | 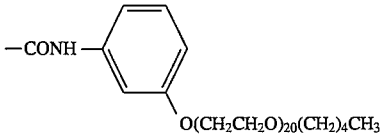 |
TABLE IC
18
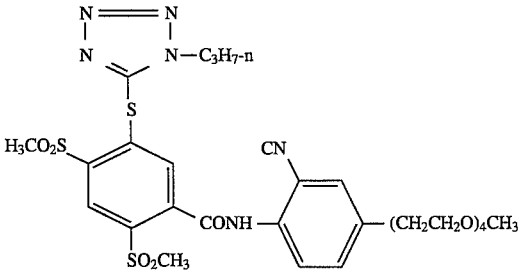
19
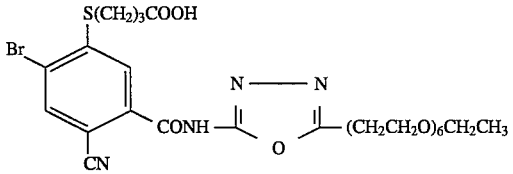
20
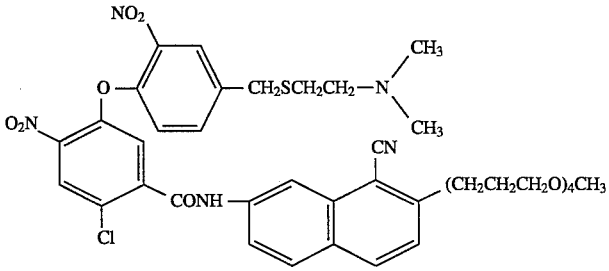

TABLE IC-continued

21

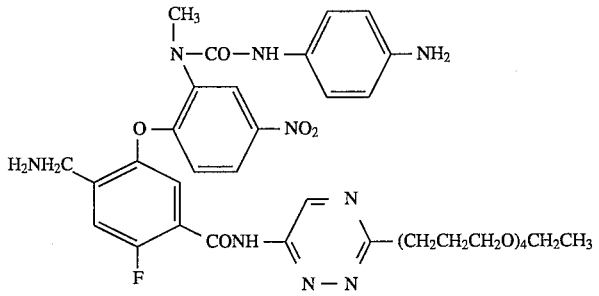

22

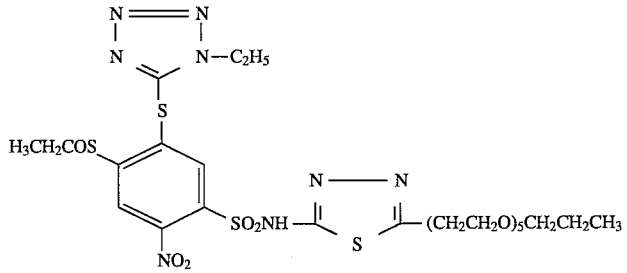

23

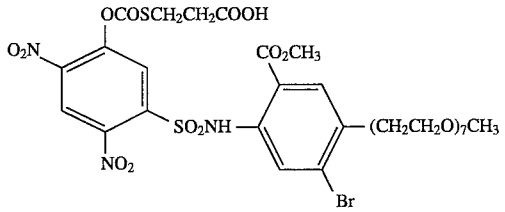

24

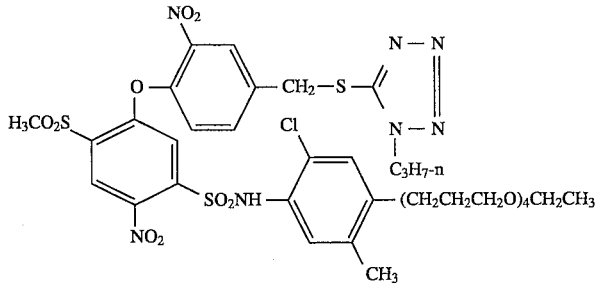

25

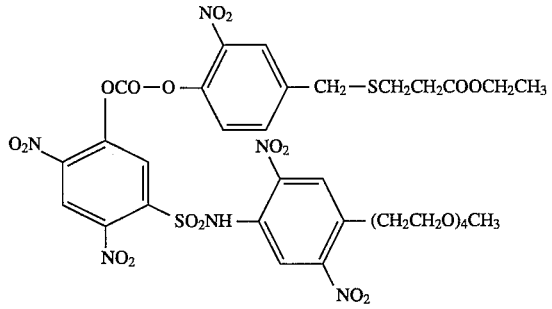

The photographic emulsions employed in this invention are generally prepared by precipitating silver halide crystals in an aqueous colloidal medium (matrix) by methods known in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum, It is known to add such dyes both before and after heat treatment.

After sensitization, the emulsion is coated on a support. Coating techniques known in the art include dip coating, air knife coating, curtain coating and extrusion coating.

The release compounds can be added to the emulsion at any time, such as during the grain growth, during or before chemical sensitization or during final melting and co-mixing of the emulsion and additives for coating. It is most desired that the compounds be added during final melting.

The release compounds can be introduced to the emulsion at the appropriate time by any means commonly practiced in the art such as by dissolving in a convenient organic solvent, or by dispersing in a gelatin matrix. They may be added to the emulsion melt during the coating process; to the vessel containing the aqueous gelatin salt solution before the start of the precipitation; or to a salt solution during precipitation. Other modes are also contemplated. Temperature, stirring, addition rates and other precipitation factors may be set within conventional ranges, by means known in the art, so as to obtain the desired physical characteristics.

Although the compounds can be added to the emulsion in virtually any organic solvent, it is preferred that they be added in a methanolic solution. By methanolic solution, it is meant a solution containing greater than 50% by weight methanol, the remainder of solution weight being accounted for by the release compound, other photographic addenda, and other organic solvents or water. Preferably, methanol accounts for greater than about 75% by weight of the solution; more preferably, it accounts for greater than about 90% by weight of the solution. Other photographic addenda may be added to the methanolic solution. Also, other solvents may be utilized along with methanol. These include acetone, cyclopentanone, ethylacetate, methylacetoacetate, propanol, ethanol and dimethylformamide.

The release compound may also be incorporated in a methanolic solution and then combined with a solution of polymer latex prior to adding to the emulsion. Particular polymer latexes suitable for the present invention include tertiary copolymers of 2-acrylamido-2-methyl propane sulfinic acid, 2-acetoacetoxy methyl methacrylate and either methyl acrylate or n-butyl acrylate. Other polymer latexes are described in U.S. Pat. Nos. 4,975,354 and 4,988,604, which are incorporated herein by reference.

A suitable level for the release compound utilized in the present invention is from about 0.01 to about 100 millimoles/mole silver, depending upon the particular release compound used and the properties of the silver halide emulsion in which it is incorporated. A preferred level is from about 0.1 to about 10 millimoles/mole silver. A more preferred level is from about 0.5 to about 2.0 millimoles/mole silver; and an optimal level is about 1.0 millimoles/mole silver.

The release compounds employed in the present invention may be incorporated into a silver halide emulsion comprising any form (i.e., cubic, octahedral, dodecahedral, spherical or tabular) of silver halide grains. It is preferred, however, that the present invention be practiced with tabular grains having an aspect ratio greater than 2:1, preferably at least 5:1, and optimally at least 7:1. Aspect ratio as used herein is understood to mean the ratio of the equivalent circular diameter of a grain to its thickness. The equivalent circular diameter of a grain is the diameter of a circle having an area equal to the projected area of the grain.

In the following Table, reference will be made to (1) *Research Disclosure*, December 1978, Item 17643, (2) *Research Disclosure*, December 1989, Item 308119, and (3) *Research Disclosure*, September 1994, Item 36544, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the black and white elements of the invention. The Table and its cited references also describe suitable ways of preparing, exposing, processing and manipulating the elements, and the images contained therein.

| Reference | Section | Subject Matter |
|---|---|---|
| 1 | I,II | Grain composition, morphology |
| 2 | I, II, IX, X, XI, XII, XIV, XV | and preparation. Emulsion preparation including hardeners, |
| 3 | I, II, III, IX A & B | coating aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | XVII | Supports |
| 2 | XVII | |
| 3 | XV | |
| 3 | XI | Specific layer arrangements |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known Kodak D-76™, HC-110™, Microdol-X™, and Polydol™ developing solutions.

Synthetic Example

The following example illustrates the synthesis of a release compound useful in the present invention. The synthesis described is representative and can be readily varied by those skilled in the art to obtain other useful release compounds.

Synthesis of Intermediate I (Tetraethylene glycol monomethyl ether mesylate)

A solution of 8.16 g (0.040M) of tetraethylene glycol monomethyl ether and 5.0 g (0.044M) of methanesulfonyl chloride in 100 ml of methylene chloride was stirred at 0° C. while 5.7 g (0.044M) of diisopropylethylamine was added dropwise so the temperature remained below 5° C. Stirring was continued at 0° C. for 20 minutes and the temperature was allowed to rise to room temperature over 2 hours. The solution was washed twice with an equal volume of water. It was then dried and concentrated to an oil, yielding 11 g (96%).

Synthesis of Intermediate II (4-(3,6,9,12-Tetraoxatridec-1-yloxy)aniline)

A mixture of 11 g (0.039M) of tetraethylene glycol monomethyl ether mesylate, 6 g (0.040M) of 4-nitrophenol, 6 g (0.040M) of potassium carbonate, and 200 ml of acetonitrile was stirred and heated at reflux for 5 hours. The solid was collected and the filtrate concentrated, dissolved in methylene chloride, washed first with dilute sodium hydroxide solution, then with water, and finally chromatographed on silica. The nitro compound was eluded with ethyl acetate, yielding 10.8 g (82%) as an oil.

A solution of 9.07 g of the nitro compound in 200 ml of ethyl acetate was reduced (10% Pd/C, 50 psi $H_2$) until complete (1 hour) and filtered through a silica plug to give 8.24 g (100%) of the amine, MP 42°–44° C.

Synthesis of Intermediate III (2,4-Dinitro-5-chloro-N-[4-(3,6,9,12-tetraoxatridec-1-yloxy)phenyl]-benzamide)

A mixture of 9.88 g (0.040M) of 2,4-dinitro-5-chlorobenzoic acid, 5.0 g (0.040M) of oxalyl chloride, and 100 ml of methylene chloride was stirred until the solid had dissolved. The solvent was removed, and 50 ml of cyclohexane was added twice and removed, The resulting acid chloride was dissolved in 100 ml of methylene chloride and added dropwise to a stirred solution of 12 g (0.040M) of 4-(3,6,9,12-tetraoxatridec-1-yloxy)aniline and 4.85 g (0.040M) of N,N-dimethylaniline in 200 ml of methylene chloride at 0° C. The mixture was stirred 1 hour at 0° C., allowed to warm to room temperature over 1 hour, washed with dilute HCl and water, and concentrated to give 21 g (99%) of the amide.

Synthesis of Compound 1

A mixture of 0.80 g (5.5 mmol) of 1-( 1-propyl)-1H-tetrazole-5-thiol, 2.6 g (5.0 mmol) of 2,4-dinitro-5-chloro-N-[4-( 3,6,9,12-tetraoxatridec-1-yloxy)phenyl]benzamide, 0.80 g (5.6 mmol) of potassium carbonate, and 25 ml of acetonitrile was stirred at room temperature for 2 hours. The solid was collected and the filtrate concentrated and chromatographed on silica with ethyl acetate, yielding 3.0 g of Compound 1 (93%), MP 88°–89° C.

The practice of the invention is described in detail below with reference to specific illustrative examples, but the invention is not to be construed as being limited thereto.

Examples

Photographic effects of the comparison and release compounds were demonstrated in a photographic film format consisting of a single light-sensitive silver halide emulsion layer coated on 100 micron, subbed acetate support and overcoated with 0.89 g gel/$m^2$. The silver halide layer contained 5.4 g/$m^2$ of silver as a 1.4 micron diameter, 0.11 micron thick, tabular grain, bromoiodide emulsion (Br:93%). The silver halide was chemically sensitized with sulfur and gold and spectrally sensitized using a combination of three sensitizing dyes. After sensitization, 10 to 20 mg/cc solutions of the comparison and release compounds were added to a solution of latex polymer and stirred for a period of time. The mixture of the two solutions was then added to the silver halide emulsion. The emulsion layer contained 4.3 g/$m^2$ gelatin and 1.6 g/$m^2$ methyl acrylate/2-acrylamido-2-methylpropane sulfonic acid/2-acetoacetoxyethyl methacrylate latex copolymer.

Sensitometry and granularity testing of comparison and release compound containing films was done as follows. Films were exposed to a simulated daylight tungsten light source for 0.01 second through a 0–4.0, 0.2 delta Log E step tablet, for sensitometry evaluations, and through an eleven step, 0.3 delta Log E granularity tablet for evaluation of granularity. The exposed samples were processed in Kodak D-76™ Developer at 20° C. with intermittent nitrogen burst agitation. Sensitometry exposures were developed for 6, 8, and 10 minutes while granularity exposures were developed for times ranging from 2 to 12 minutes. The effects of the release compounds upon partial grain development were examined and are set forth in subsequent tables.

Relative exposure differences were determined at a net image density of 0.10 to provide a measure of the photographic speed effects of the comparison and invention compounds. Effects on contrast were monitored in terms of the so-called contrast index as defined in James, "The Theory of the Photographic Process", 4th Ed., page 502, 1977.

The relative speed/grain performances of comparative and invention films were evaluated by graphical analysis of time-of-development granularity/density data. This analysis is explained as follows: At constant exposure, both granularity and density increase with development time due to an increase in the size of the developing image centers. Profiles of granularity versus density with increasing development time at constant exposure for each of the steps on an eleven-step granularity tablet form an array of curvilinear lines that radiate with various slopes from the granularity/density origin. The granularity/density profiles corresponding to lower exposures have higher slopes than higher exposure profiles because fewer image grains are developed at the lower exposures.

The granularity/density profiles of films with and without incorporated release compounds or development inhibitors can be compared to determine whether shifts in the granularity/density profiles occur at matched exposures. Any offset between granularity/density profiles at matched exposure indicates that the number of developing image centers has been affected by the presence of the release compound or development inhibitor. For example, if the density/granularity profile with release compound or development inhibitor for a given exposure has a higher slope than the profile of a control at matched exposure, then it can be concluded that the release compound or development inhibitor has reduced the number of image grains and thereby adversely impacted speed/grain performance.

A measure of the speed/grain impact is the additional exposure required to overlay (i.e., match) the granularity/density profiles of control and release compound or development inhibitor containing films. This impact, in terms of stops of additional exposure given the release compound or development inhibitor containing film, is calculated by graphical interpolation of the eleven exposure granularity/density profile arrays of the two films. The exposure offset of the granularity/density profiles at exposures in the critical midtone (5th step) range is most relevant to practical image quality and is therefore reported as the relative speed/grain position in the examples which follow.

Comparative Example A

Comparative Compound A, ethylmercaptotetrazole, shown below, was added as a 15 mg/cc methanol solution to the coating format described above to yield final EMT levels in the silver halide layer of 0, 0.5 and 1.0 mmol/Ag mol. The photographic speed and contrast index (CI) data in Table I show that while this unblocked development inhibitor lowers contrast at each development time, a substantial speed loss is suffered, particularly as the level of Compound A is increased.

Comparative Compound A

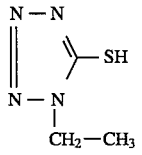

TABLE I

| Amount Cpd A Coated (mmol/Ag mol) | Dev. Time (min) | Relative Speed* | CI |
|---|---|---|---|
| 0 | 6 | 100 | 0.82 |
| | 8 | 117 | 1.09 |
| | 10 | 129 | 1.46 |
| 0.5 | 6 | 85 | 0.68 |
| | 8 | 98 | 0.81 |
| | 10 | 102 | 1.17 |
| 1.0 | 6 | 45 | 0.68 |
| | 8 | 49 | 0.79 |
| | 10 | 50 | 1.14 |

*Relative speed = 100 × (Exposure of Reference/Exposure of Test) where reference is 6 minutes development of the unrestrained control and both exposures are measured at 0.10 net image density.

The relative speed/grain positions of the 0, 0.5 and 1.0 mmol/Ag mol levels of Compound A established from time-of-development granularity data in the midtone exposure range are listed in Table II. These data show the unblocked development inhibitor, incorporated into the film without a delayed release mechanism, causes a significant loss of image quality. These losses in image quality are interpreted to mean that Compound A prevents some of the exposed image grains from developing, thereby lowering the number of image centers and raising the granularity.

TABLE II

| Amount of Cpd A Coated (mmol/Ag mol) | Relative Speed/Grain (stops of Exposure) |
|---|---|
| 0 | 0.00 |
| 0.5 | −0.50 |
| 1.0 | −1.50 |

Comparative Example B

Comparative Compound B, an ethylmercaptotetrazole-releasing compound was added to the coating format described above as a 15 mg/cc solution in 50/50 methanol/dimethylformamide as the solvent. A significant amount of dimethylformamide had to be used due to the limited solubility of this compound in methanol. Compound B levels in the silver halide emulsion layer of the final coatings were 0, 0.4 and 0.6 mmol/Ag mol. Photographic speed and contrast index (CI) data in Table III demonstrate favorable restraint of contrast with little impact upon photographic speed relative to comparative compound A. As the level of Compound B is increased, contrast restraint continuously increases whereas photographic speed actually increases slightly at lower levels of Compound B before decreasing slightly at higher amounts.

Comparative Compound B
(Compound 5 of U.S. Ser. No. 08/250,148)

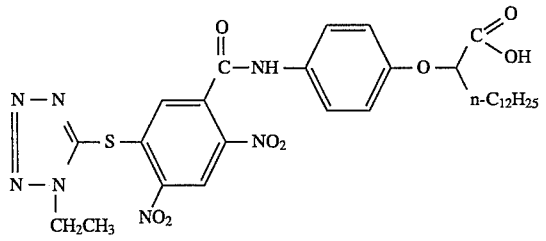

TABLE III

| Amount Cpd B Coated (mmol/Ag mol) | Dev. Time (Min) | Relative Speed* | CI |
|---|---|---|---|
| 0 | 6 | 100 | 0.78 |
| | 8 | 126 | 1.17 |
| | 10 | 129 | 1.39 |
| 0.4 | 6 | 102 | 0.66 |
| | 8 | 129 | 0.91 |
| | 10 | 135 | 1.10 |
| 0.6 | 6 | 98 | 0.58 |
| | 8 | 120 | 0.80 |
| | 10 | 126 | 0.99 |

*Relative speed = 100 × (Exposure of Reference/Exposure of Test) where reference is 6 minutes development of the unrestrained control and both exposures are measured at 0.10 net image density.

As Table IV indicates, no detectable loss in relative speed/grain was seen with Compound B incorporated into the film. The advantage of delaying release of the development inhibitor allowed all exposed grains to begin to developing in the early stages of processing thereby not reducing the number of image centers.

TABLE IV

| Amount of Cpd B Coated (mmol/Ag mol) | Relative Speed/Grain (stops of Exposure) |
|---|---|
| 0 | 0.00 |
| 0.0 | 0.00 |
| 1.0 | 0.00 |

Inventive Example I

Increased methanol solubility of Compound 1 versus Comparison Compound B allowed it to be incorporated into the film from a 15 mg/cc solution with 88.2% methanol/9.8% dimethylformamide (2.0% compound 1 or B) as the solvent. Table V below shows 6, 8 and 10 minute sensitometry results for 0, 0.75, 1.0 and 1.5 mmol/Ag mol coverages of Compound 1. Contrast restraint without significant speed effects similar to those shown above by Comparative Compound B are achieved with a more methanol-soluble releasing compound.

Relative speed/grain estimates in the midtone range of exposures for Compound 1 containing films are listed in Table VI. A just-detectable loss in speed/grain is seen with this compound incorporated in the film. However, the speed/grain performance of the emulsion is significantly better preserved during development by the delayed-release type mechanism offered by Compound 1 than by the unblocked mechanism offered by Comparative Compound A.

TABLE V

| Amount Cpd 1 Coated (mmol/Ag mol) | Dev. Time (Min) | Relative Speed* | CI |
|---|---|---|---|
| 0 | 6 | 100 | 0.71 |
| | 8 | 129 | 1.06 |
| | 10 | 138 | 1.46 |
| 0.75 | 6 | 105 | 0.65 |
| | 8 | 132 | 0.92 |
| | 10 | 145 | 1.20 |
| 1.0 | 6 | 102 | 0.63 |
| | 8 | 132 | 0.90 |
| | 10 | 141 | 1.14 |
| 1.5 | 6 | 98 | 0.58 |
| | 8 | 126 | 0.84 |
| | 10 | 138 | 1.05 |

*Relative speed = 100 × (Exposure of Reference/Exposure of Test) where reference is 6 minutes development of the unrestrained control and both exposures are measured at 0.10 net image density.

TABLE VI

| Amount of Cpd 1 Coated (mmol/Ag mol) | Relative Speed/Grain (stops of Exposure) |
|---|---|
| 0 | 0 |
| 0.75 | −0.15 |
| 1.00 | −0.15 |
| 1.50 | −0.20 |

Inventive Example II

Compound 5, a mercaptooxadiazole-releasing analog of Compound 1, was added to the test film format from 15 mg/cc solutions in pure methanol to provide Compound 5 coverages of 0, 0.75, 1.00 and 1.50 mmol/Ag mol in the silver halide emulsion layer.

In Table VII, significant reductions in contrast and only slight reductions in speed are seen with Compound 5 incorporated versus the unrestrained control; and for a given degree of contrast restraint, speed actually increases. This directly contrasts with the case where an unblocked development inhibitor is incorporated into the emulsion (Comparative Example A). In this latter case, for a given degree of contrast restraint, speed decreases substantially.

Relative speed/grain evaluations presented in Table VIII for incorporated Compound 5 show that only relatively small losses in image quality occur.

TABLE VII

| Amount Cpd 5 Coated (mmol/Ag mol) | Dev. Time (Min) | Relative Speed* | CI |
|---|---|---|---|
| 0 | 6 | 100 | 0.68 |
| | 8 | 126 | 0.98 |
| | 10 | 145 | 1.34 |
| 0.75 | 6 | 87 | 0.55 |
| | 8 | 105 | 0.71 |
| | 10 | 120 | 0.92 |
| 1.0 | 6 | 87 | 0.52 |
| | 8 | 107 | 0.67 |
| | 10 | 117 | 0.81 |
| 1.5 | 6 | 78 | 0.48 |
| | 8 | 100 | 0.59 |
| | 10 | 107 | 0.68 |

*Relative speed = 100 × (Exposure of Reference/Exposure of Test) where reference is 6 minutes development of the unrestrained control and both exposures are measured at 0.10 net image density.

TABLE VIII

| Amount of Cpd 5 Coated (mmol/Ag mol) | Relative Speed/Grain (stops of Exposure) |
|---|---|
| 0 | 0 |
| 0.75 | −0.20 |
| 1.00 | −0.30 |
| 1.50 | −0.40 |

The invention has been described in detail with particular reference to preferred embodiments thereof, but it will be understood that variations and modifications can be effected within the spirit and scope of the invention.

What is claimed is:

1. A black and white photographic element comprising a support having situated thereon at least one silver halide emulsion, the element containing a release compound that provides a non-imagewise distribution of a photographically active moiety, wherein the release compound is unballasted and has the structure

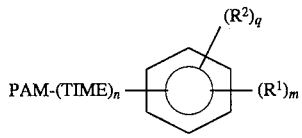

wherein $R^1$ is an electron withdrawing moiety;

m is 0, 1, 2 or 3;

$R^2$ is a group containing an aqueous solubilizing group, the aqueous solubilizing group containin a polyether comprising a polyethyleneoxy chain having at least 4 repeating units;

q is 1 or 2;

TIME is a timing group;

n is 0, 1, 2 or 3; and

PAM is a photographically active moiety.

2. A black and white photographic element according to claim 1 wherein the polyether comprises a polyethyleneoxy chain having from 4 to about 20 repeating units.

3. A black and white photographic element according to claim 2 wherein the release compound has the structure

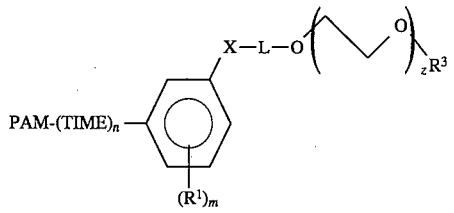

wherein

PAM, TIME, n, $R^1$ and m are as defined in claim 1;

X is selected from CONH or $SO_2NH$;

L is a linking group comprising an aromatic substituent;

z is from 4 to 20; and $R^3$ is an alkyl or aryl group having less than 12 carbon atoms.

4. A black and white photographic element according to claim 3 wherein $R^3$ is an alkyl or aryl group having less than 8 carbon atoms.

5. A black and white photographic element according to claim 4 wherein the release compound has the structure

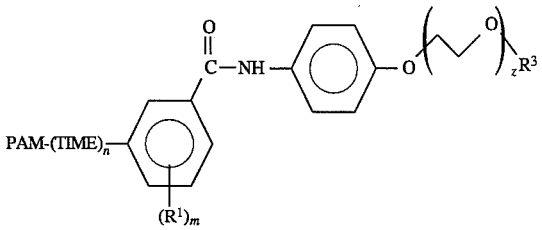

wherein

PAM, TIME, n, $R^1$ and m are as defined in claim 1;

z is from 4 to 20; and $R^3$ is an alkyl or aryl group having less than 8 carbon atoms.

6. A black and white photographic element according to claim 5 wherein $R^3$ is an alkyl group having less than 5 carbon atoms.

7. A black and white photographic element according to claim 6 wherein the active functionality of the photographically active moiety is a heteroatom which is blocked by direct attachment to the remainder of the release compound.

8. A black and white photographic element according to claim 7 wherein the photographically active moiety is a development inhibitor moiety.

9. A black and white photographic element according to claim 8 wherein the release compound is selected from the group consisting of

1

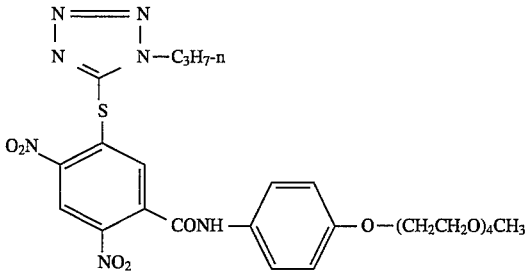

5

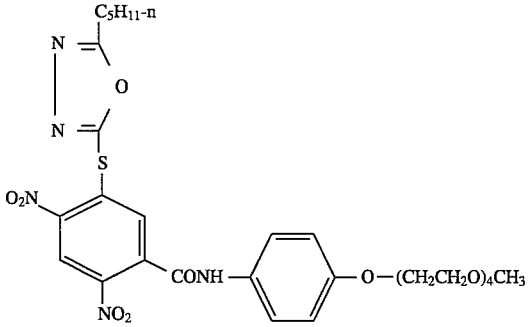

14

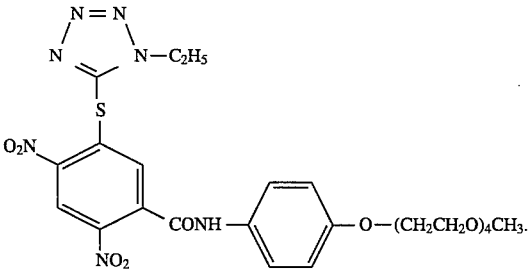

* * * * *